US006978484B2

(12) United States Patent
Donlan et al.

(10) Patent No.: US 6,978,484 B2
(45) Date of Patent: Dec. 27, 2005

(54) CONVERTIBLE PANTS AND METHODS FOR MAKING SAME

(75) Inventors: Thomas E. Donlan, Bentonville, AR (US); James P. Martin, Springdale, AR (US)

(73) Assignee: Wal-Mart Stores, Inc., Bentonville, AR (US)

( * ) Notice: Subject to any disclaimer, the term of this patent is extended or adjusted under 35 U.S.C. 154(b) by 0 days.

(21) Appl. No.: 10/845,871

(22) Filed: May 14, 2004

(65) Prior Publication Data

US 2005/0251896 A1 Nov. 17, 2005

(51) Int. Cl.[7] ..... A41D 13/00
(52) U.S. Cl. ..... 2/227; 2/247
(58) Field of Search ..... 2/227, 228, 269, 2/79, 69, 85, 108, 93, 94, 95, 247–251

(56) References Cited

U.S. PATENT DOCUMENTS

| | | | | |
|---|---|---|---|---|
| 1,354,289 | A | 9/1920 | Feige | |
| 1,922,594 | A | 8/1933 | Lippstadt | |
| 2,104,826 | A | 11/1938 | Stramiello | |
| D134,547 | S | 12/1942 | Frankel | |
| 2,308,411 | A | 1/1943 | Wolfson | |
| 2,313,519 | A | 3/1943 | Cuttler | |
| 2,677,131 | A | 5/1954 | Shuster | |
| 2,840,825 | A | 7/1958 | Garrido | |
| 3,287,739 | A | 11/1966 | Kaplan | |
| 4,006,495 | A | 2/1977 | Jones | |
| 4,190,908 | A | 3/1980 | Herskind | |
| 4,261,059 | A | 4/1981 | Spitz | |
| D261,324 | S | 10/1981 | Catron | |
| 4,302,850 | A | 12/1981 | Maeshima | |
| 4,321,710 | A | 3/1982 | Off | |
| 4,347,629 | A * | 9/1982 | Itoi | 2/108 |
| 4,446,573 | A | 5/1984 | Green | |
| 4,534,067 | A | 8/1985 | Richardson | |
| 4,549,315 | A | 10/1985 | English et al. | |
| 4,766,613 | A * | 8/1988 | Wells | 2/227 |
| 4,846,087 | A | 7/1989 | Hinckle | |
| 5,033,117 | A | 7/1991 | Fairweather | |
| 5,153,944 | A | 10/1992 | Teel | |
| D333,203 | S | 2/1993 | Jones | |
| D341,693 | S | 11/1993 | Nichols et al. | |
| D341,919 | S | 12/1993 | Grimes | |
| 5,544,366 | A | 8/1996 | Kato | |
| 5,598,586 | A | 2/1997 | Munjone | |
| 5,669,078 | A | 9/1997 | Scremin et al. | |
| 5,774,892 | A * | 7/1998 | Tisdale et al. | 2/69 |
| 5,864,888 | A | 2/1999 | Archer | |
| 5,943,699 | A | 8/1999 | Barbeau | |
| 6,158,056 | A * | 12/2000 | Riley | 2/269 |
| 6,253,379 | B1 | 7/2001 | Collier | |
| 6,311,333 | B1 | 11/2001 | Batra | |
| D452,988 | S | 1/2002 | Ergezinger et al. | |
| 6,421,839 | B1 * | 7/2002 | Vo et al. | 2/227 |

* cited by examiner

*Primary Examiner*—Gloria M. Hale
(74) *Attorney, Agent, or Firm*—Priest & Goldstein, PLLC

(57) ABSTRACT

First and second pant legs are removably attached to a pair of shorts to form a pair of long pants. A pouch is attached to an interior surface of the first pant leg. The pouch has a mouth that is accessible through an opening in the first pant leg. The pouch is dimensioned and positioned to receive the first and second pant legs after they have been removed from the shorts and folded up.

20 Claims, 7 Drawing Sheets

CONVERTIBLE PANTS AND METHODS FOR MAKING SAME

BACKGROUND OF THE INVENTION

1. Field of the Invention

The present invention relates generally to the field of clothing, and more particularly to advantageous aspects of improved convertible pants and methods for making same.

2. Description of Prior Art

In certain situations, it is desirable for a pair of long pants to be convertible into a pair of shorts. For example, when camping, hiking, traveling, or exercising, it may be desirable to be able to change between full length and short pants, but it may be impractical or inconvenient to carry two separate pairs of pants. So-called "convertible" pants have been developed, in which a pair of full length pants is provided with legs that are removable to form a pair of shorts. However, once the pant legs have been removed, there typically has been no convenient way to store and carry them.

SUMMARY OF THE INVENTION

These and other issues are addressed by the present invention, aspects of which provide convertible pants and methods for making same. A pair of pants according to a first aspect of the invention includes a pair of shorts and first and second pant legs removably attached to the shorts to form a pair of long pants. A pouch is attached to an interior surface of the first pant leg. The pouch has a mouth that is accessible through an opening in the first pant leg. The pouch is dimensioned and positioned to receive the first and second pant legs after they have been removed from the shorts and folded up.

Additional features and advantages of the present invention will become apparent by reference to the following detailed description and accompanying drawings.

DETAILED DESCRIPTION

An aspect of the present invention provides a pair of convertible pants having first and second legs that are removable to form a pair of shorts. A pouch is attached to the inside of the first pant leg. The pouch is dimensioned and positioned such that when the first and second pant legs have been removed from the pants, they may be folded up and stored inside the pouch. The pouch is further provided with a utility connector that allows the pouch containing the pant legs to be clipped onto a ring located at the pants' waistline.

Figure 1:
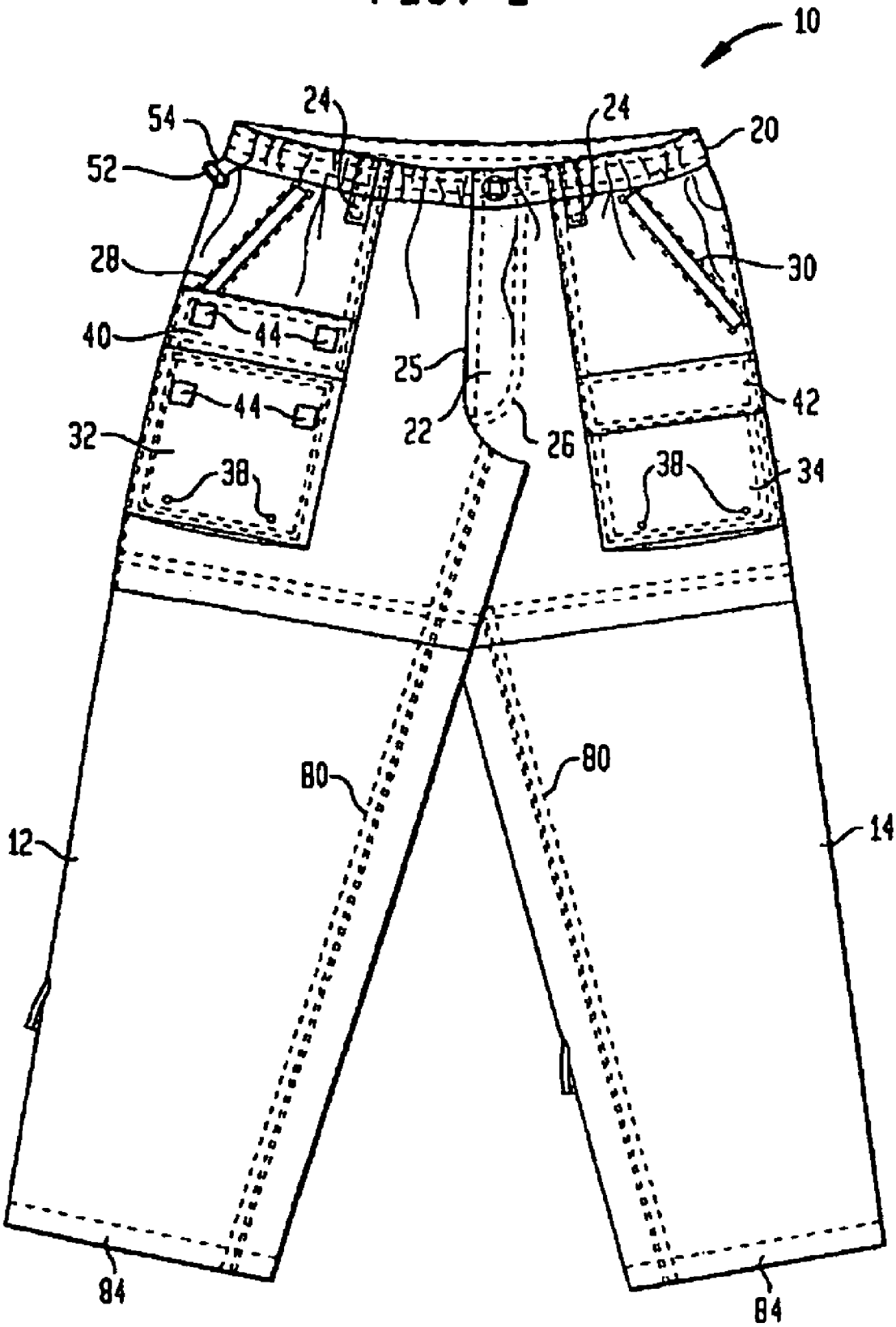
FIG. 1 shows a front view of a pair of convertible pants according to a first aspect of the invention.
Figure 2:
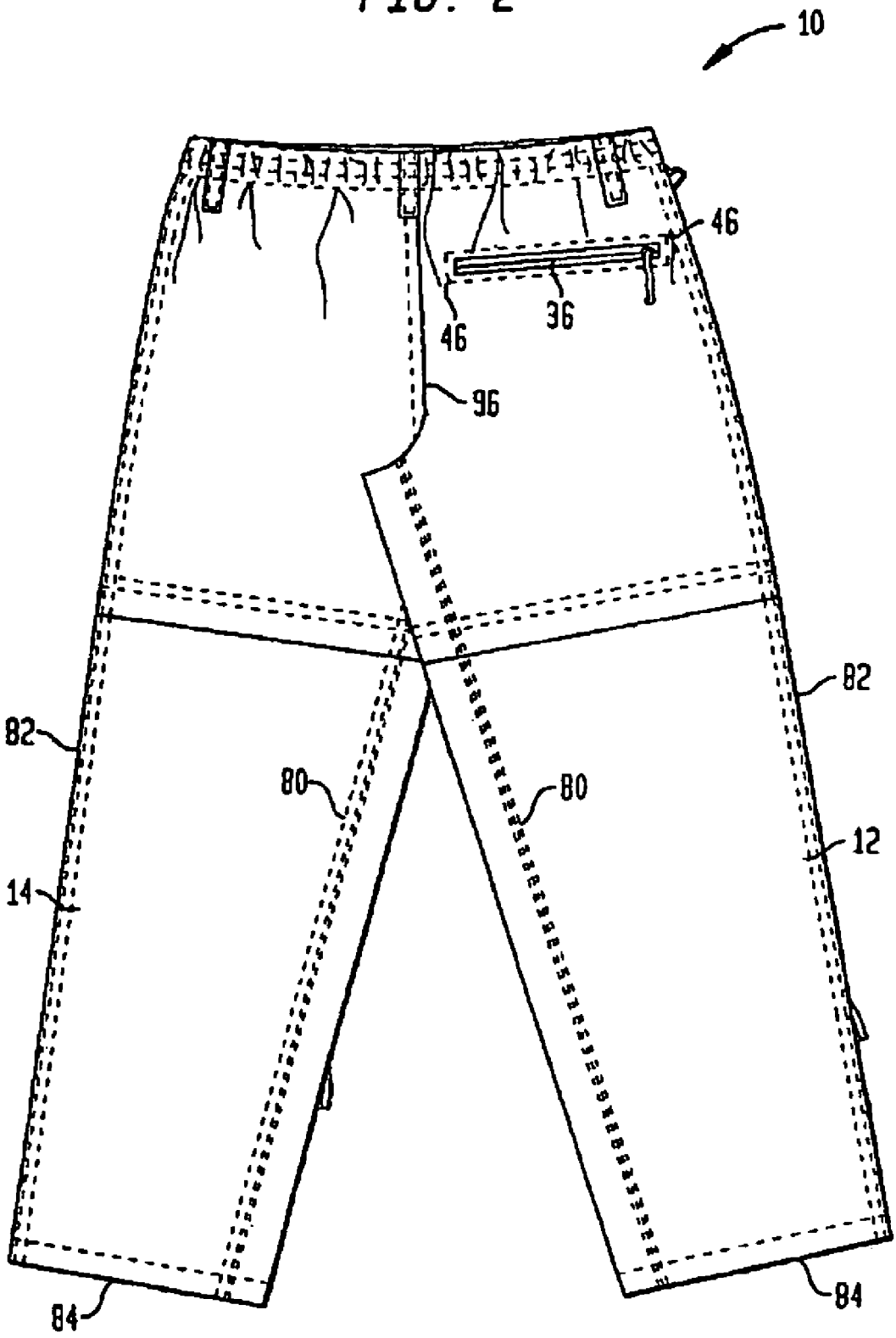
FIG. 2 shows a rear view of the pants shown in FIG. 1.
Figure 3:
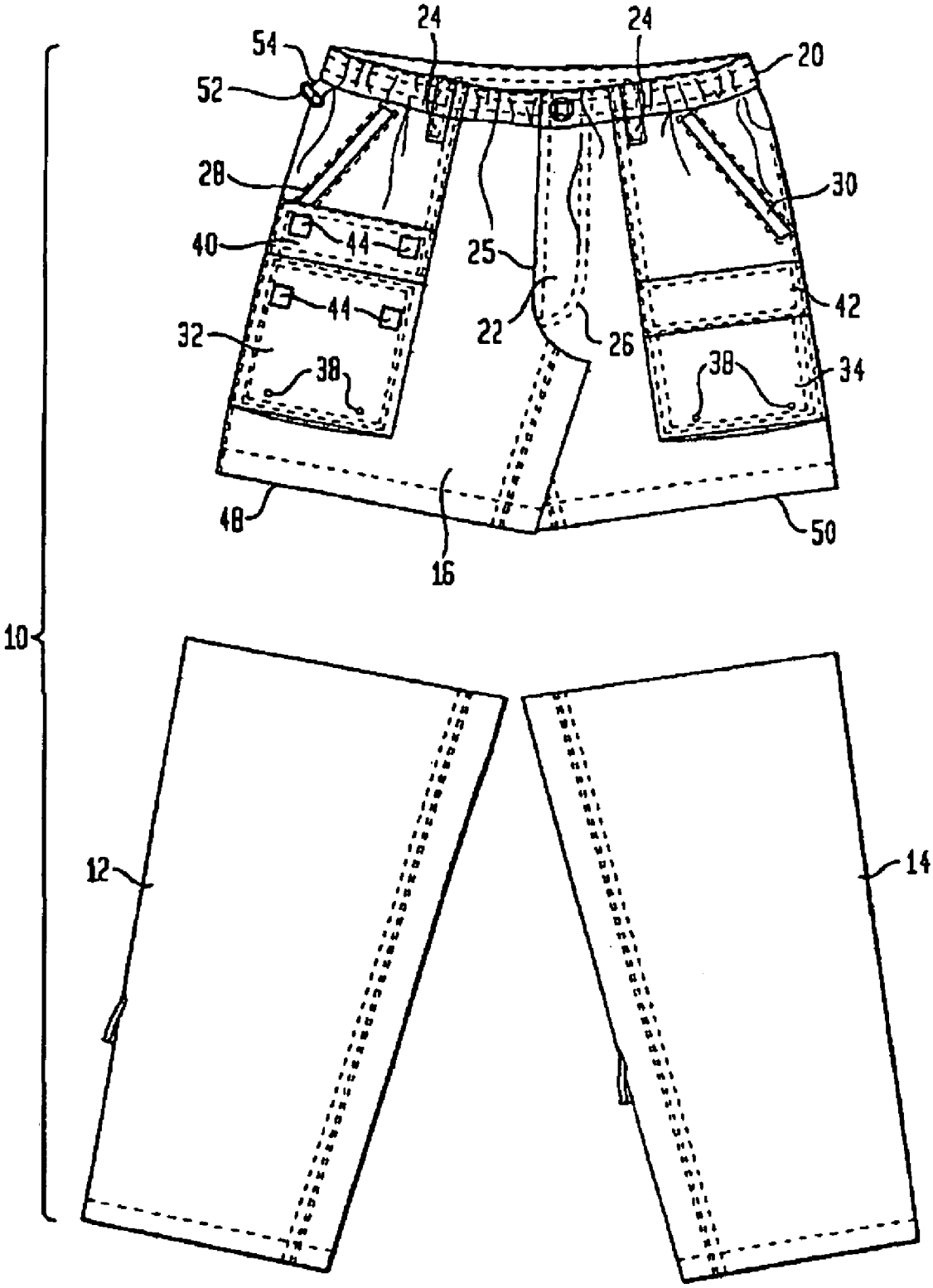
FIG. 3 shows an exploded front view of the pants shown in FIG. 1.

FIGS. 1 and 2 show, respectively, front and rear views of a pair of convertible pants 10 according to a first aspect of the invention. The pants 10 include first and second pant legs 12 and 14, which are removable. FIG. 3 shows a front view of the pants 10 shown in FIGS. 1 and 2 with the first and second pant legs 12 and 14 detached, leaving a pair of shorts 16.

The pants 10 include a full elastic waistband 20, a zip front fly 22, and belt loops 24. The fly 22 includes a double needle stitched fly edge 25, a J-stitch 26, and two corner bartacks (not shown). The pants 10 are further provided with five pockets: a right front thigh pocket 28, a left front thigh pocket 30, a right front cargo pocket 32, a left front cargo pocket 34, and a right rear hip pocket 36.

The cargo pockets 32 and 34 are provided with a 1" self-fabric bellow (not shown) and stitched grommets 38. The grommets 38 are useful, for example, to allow water to run out of the cargo pockets 32 and 34. The cargo pockets 32 and 34 are further provided with respective flaps 40 and 42. For purposes of illustration, the right cargo pocket flap 40 has been folded into its open position, while the left cargo pocket flap 42 has been folded into its closed position.

The cargo pocket flaps 40 and 42 are held closed by squares of hook and loop tape 44 stitched onto the inner surface of the flaps 40 and 42 and onto corresponding positions on the cargo pockets 32 and 34. The stitching of the hook and loop tape 44 is performed such that it is not visible from the outside of the flaps 40 and 42. The right rear hip pocket 36 is a double welt zip pocket with corner bartacks 46. There are also bartacks (not shown) at the corners of the other pockets 28, 30, 32 and 34, and at the corners of the pocket flaps 40 and 42. The inseams 80 and side seams 82 are double needle mock felled seams. Each pant leg 12 and 14 further includes a cleaned turned leg hem 84, double needle stitched. The rises 96 (FIG. 2) are double needle mock felled seams.

The first and second pant legs 12 and 14 are each held in position by a zipper (not shown). According to the present aspect of the invention, the zipper sliders are placed on the pant legs 12 and 14. The leg openings 48 and 50 of the shorts 16, shown in FIG. 3, are double needle stitched with a self-fabric zipper facing.

The pants 10 further include a D-ring 52, attached to the seam of the waistband 20 with a self-fabric loop 54 on the wearer's right side. As discussed below, the D-ring 52 can be used to hold the pant legs 12 and 14 after they have been removed and stored in pouch 60, as described below. However, the D-ring may also be put to other uses by the wearer of the pants. For example, the wearer may use the D-ring to hold a set of keys, cell phone, or the like.

Figure 4:
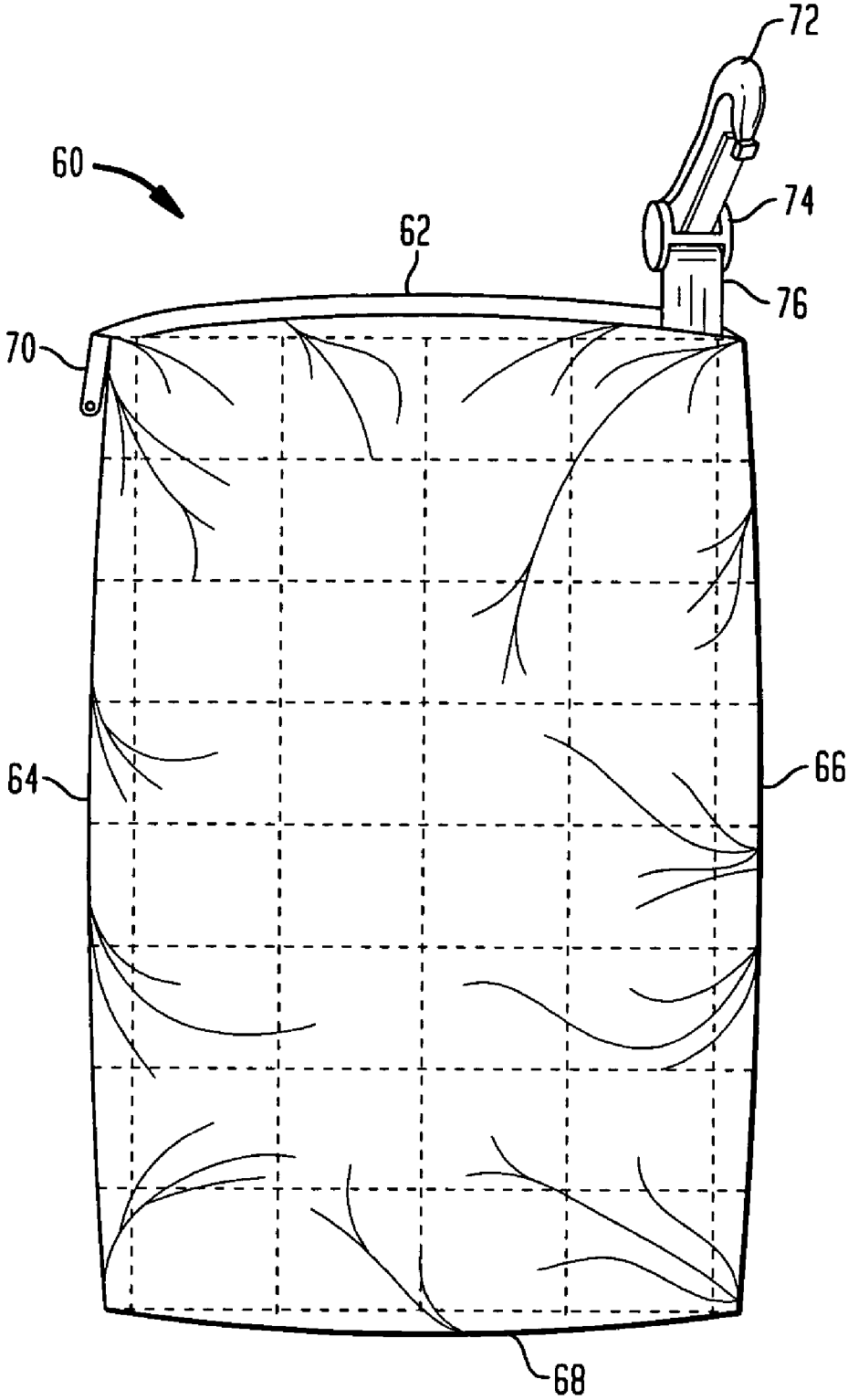
FIG. 4 shows a front view of a pouch suitable for use in the pants shown in FIG. 1.
Figure 5:
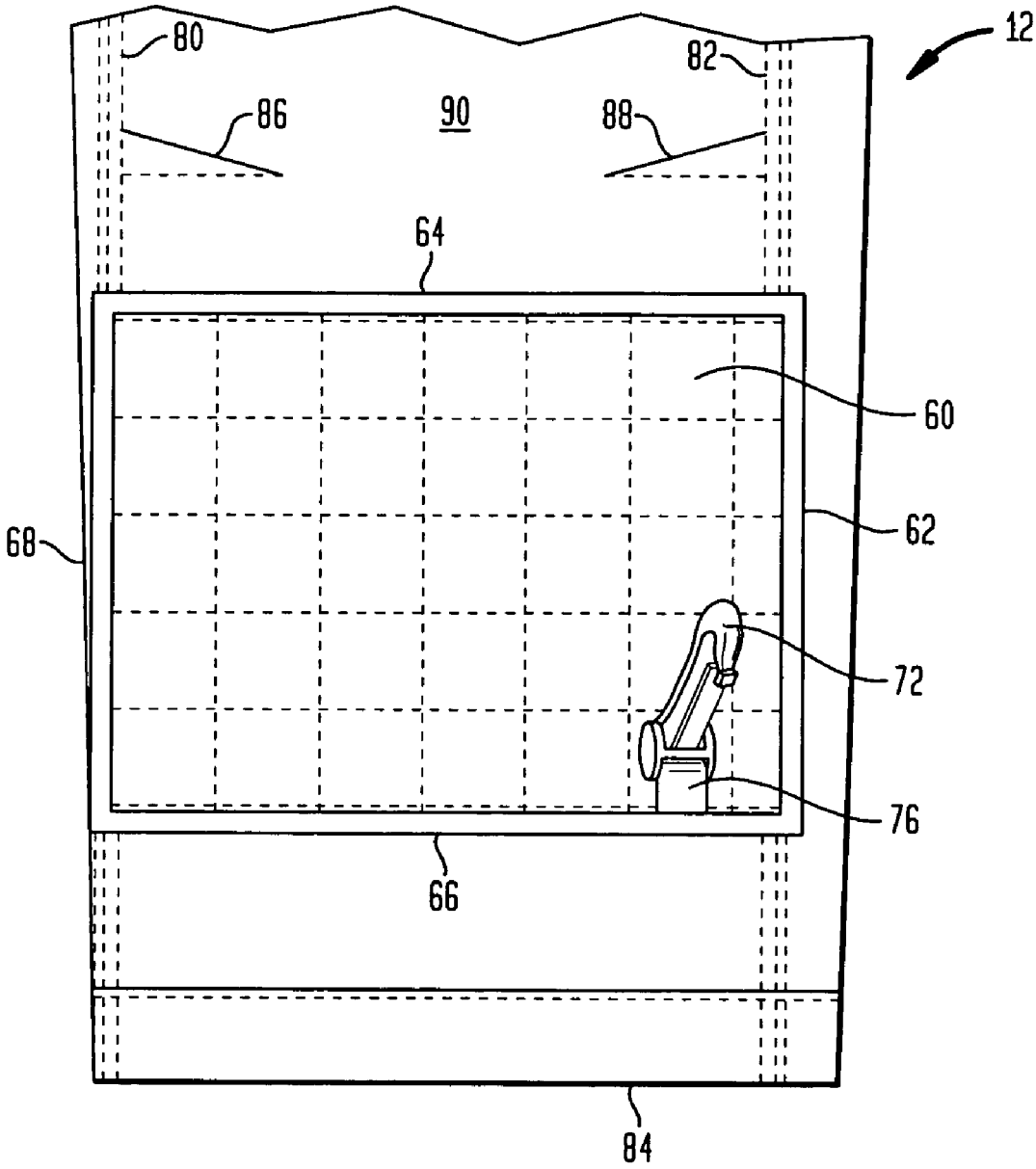
FIG. 5 shows a partial interior view of a pant leg including the pouch shown in FIG. 4.

FIG. 4 shows a front view of a pouch 60 according to an aspect of the invention. As mentioned above, the pouch 60 is provided to store the pant legs 12 and 14 after they have been removed from the shorts 16. As shown in FIG. 5, the pouch 60 has a substantially rectangular profile, with a zippered mouth 62 at the top of the pouch 60, a left side 64, a right side 66, and a bottom 68. A zipper pull 70 is provided to unzip the mouth 62 to gain access to the interior of the pouch 60. Also, in the upper right corner of the pouch 60 there is provided a utility connector 72 that is attached to the pouch 60 by a D-ring 74 and fabric loop 76. The utility connector 72 allows the wearer to attach the pouch 60 to the D-ring 52 at the waistband of the shorts 16 shown in FIG. 3. The utility connector 72 may also be used to attach the pouch 60 to other loops or rings, such as a ring on a backpack, a hook in a closet, or the like. In FIG. 4, the first and second pant legs 12 and 14 have been folded up and are contained within the pouch 60, with the zippered mouth 62 zipped shut.

As mentioned above, according to an aspect of the invention, the pouch 60 is attached to the inside of the first pant leg 12. The location of the pouch 60 is illustrated in FIG. 5, which shows a partial interior view of the lower portion of the first pant leg 12. The first pant leg 12 includes an inseam 80, a side seam 82, and a bottom hem 84. In addition, the first pant leg 12 includes a pair of darts 86 and 88 defining the bottom of the knee 90. The pouch 60 is stitched sideways to the front interior of the first pant leg 12 between the knee 90 and the bottom hem 84. Different approaches may be used to stitch the pouch 60 into the first pant leg 12. According to one aspect of the invention, the pouch bottom 68 is sewn along the inseam 80 and the pouch's zippered mouth 62 is sewn along the side seam 82. The pouch's left side 64 and right side 66 are stitched to corresponding regions of the inner surface of the first pant leg 12. However, it would also be possible, without departing from the spirit of the invention, to leave one or more of the pouch's left side 64, right side 66, and bottom 68 unattached to the first pant leg 12. It should also be noted that, if desired, a second pouch (not shown) may be provided in the second pant leg 14 or in another location in the pants 10 or shorts 16.

Figure 6:
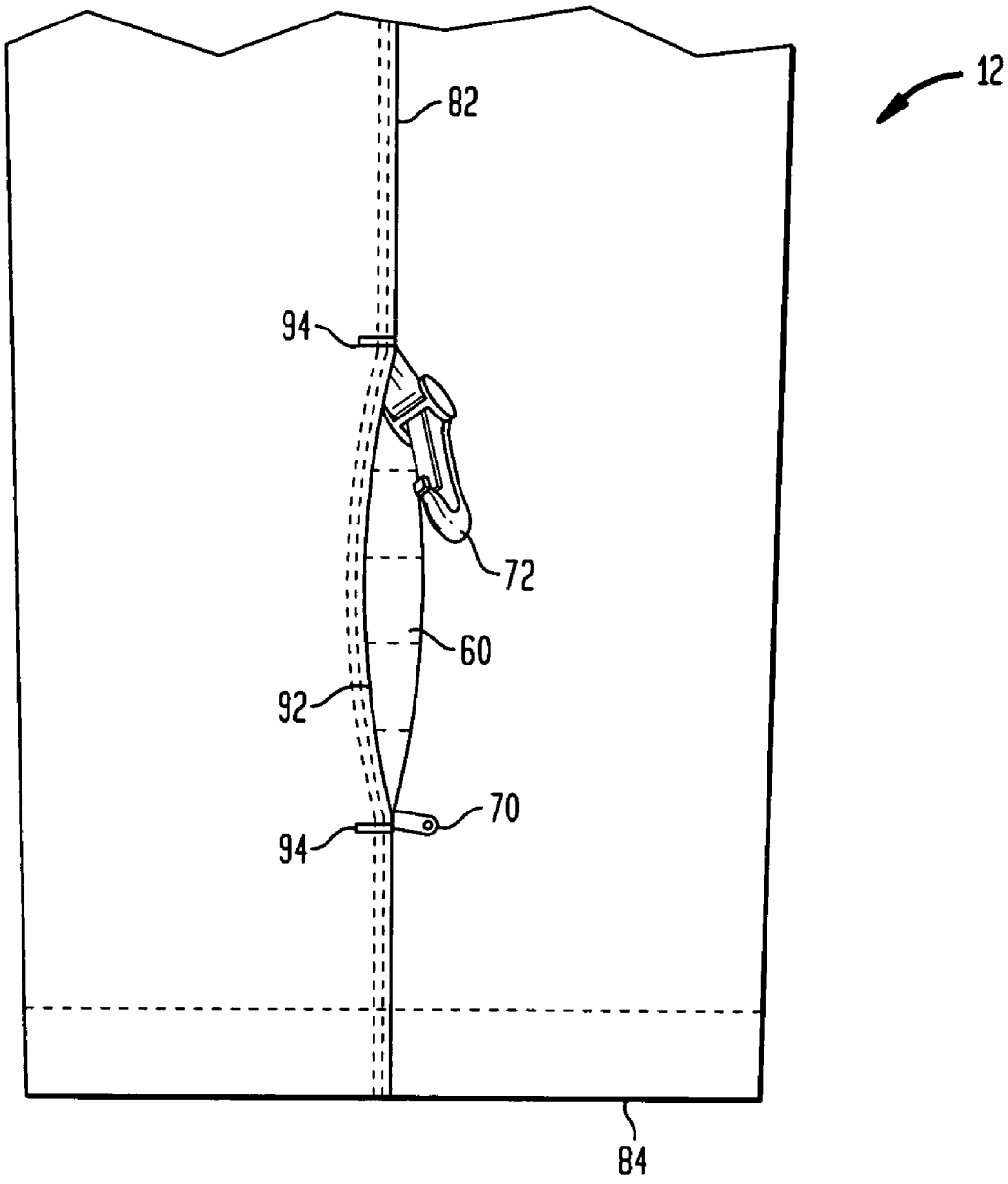
FIG. 6 shows a partial side view of the pant leg shown in FIG. 5.

FIG. 6 shows a side view of the lower portion of the first pant leg 12. As shown in FIG. 6, the pant leg 12 is provided with a slit 92 lying along the side seam 82. Each end of the slit 92 is reinforced with a bartack 94. The slit 92 lines up with the pouch's zippered mouth 62. The zipper pull 70 is accessible through the slit 92 allowing the mouth of the pouch 60 to be zipped and unzipped through the slit 92. The utility connector 72 is affixed to an inside seam of the pouch 60 so that the connector 72 is contained within the pouch 60 when the pouch 60 is zipped up. According to one aspect of the present invention, the pouch has an opening with a length of 5 inches. The pouch is sewn into the first pant leg such that the bottom of the pouch opening is 5 inches from the bottom hem 84.

FIG. 6 illustrates an alternative embodiment of the invention, in which the pouch 60 in sewn into the interior of the first pant leg 12 such that the utility connector 72 is located proximate to the knee 90 and the zipper pull 70 is located proximate to the bottom hem 84. In FIG. 5, the pouch 60 is sewn into the interior of the first pant leg 12 such that the utility connector 72 is located proximate to the bottom hem 84. It will be appreciated that the present invention may be practiced using either location for the utility connector 72 and the zipper pull 70.

According to a further aspect of the invention, the pant legs 12 and 14 are stored as follows. The pant legs 12 and 14 are removed from the "shorts" portion 16 of the pants 10 by unzipping them, and the mouth of the pouch 60 is also unzipped. The second pant leg 14 is then placed on top of the first pant leg 12, and the two pant legs 12 and 14 are then folded or rolled into position over the pouch 60. The pouch 60 is then turned inside out, so that the folded up pant legs are now inside the pouch 60.

Other techniques may be used to store the pant legs 12 and 14 into the pouch 60. For example, it would be possible to store one pant leg at a time. The first pant leg 12 could be done first, and then the second pant leg 14 would be folded up and inserted into the pouch 60.

According to an aspect of the invention, the pants 10 are fabricated from a lightweight, breathable synthetic or blended material that may be waterproof or water-resistant. The use of a lightweight material facilitates the folding of the pant legs into the pouch.

It will be appreciated that the above described pants may be modified without departing from the spirit of the invention. For example, the pant legs can be replaceable with legs of different colors, materials, lengths and cuts. The pant legs may be thermally insulated or waterproof, for example. In addition, the pant legs can be reversible, to allow the wearer to alter the appearance of the pants. Also, the location of the zippers used to attached to the pant legs to the shorts can be modified create shorts having different lengths and appearances.

Also, in the pants described above, the first pant leg 12 is the right pant leg. However, it would also be possible to make the first pant leg the left pant leg without departing from the spirit of the invention. It should also be noted that the pouch may be used as a pocket, apart from storing the pant legs.

Figure 7:
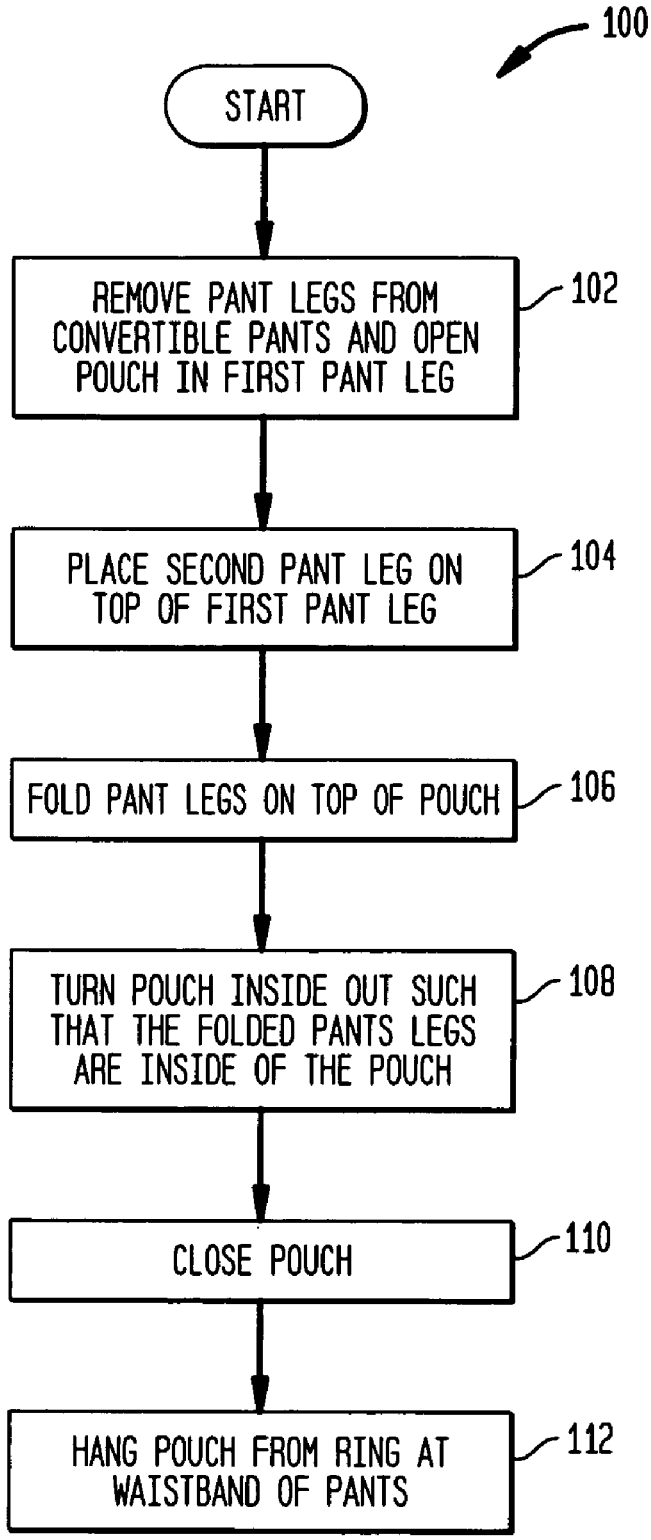
FIG. 7 shows a flowchart of a method according to a further aspect of the invention for storing pant legs from a pair of convertible pants.

FIG. 7 shows a flowchart of a method 100 according a further aspect of the invention for storing pant legs from a pair of convertible pants. In step 102, the pant legs are removed from the pants, and a pouch in a first pant leg is opened. In step 104, the second pant leg is placed on top of the first pant leg and, in step 106, the pant legs are folded into a configuration in which both pant legs overlay the pouch. In step 108, the pouch is turned inside out such that the folded pant legs are tucked inside of the pouch. In step 110, the pouch is closed, and in step 112 the pouch is hung from a ring at the waistband of the pants.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

We claim:

1. A pair of pants, comprising:

a pair of shorts;

first and second pant legs removably attached to the shorts to form a pair of long pants; and a pouch attached to an interior surface of the first pant leg, the pouch having a mouth that is accessible through an opening in the first pant leg, the pouch being dimensioned and positioned to receive the first and second pant legs after they have been removed from the shorts and folded up.

2. The pants of claim 1, wherein the first pant leg includes a knee portion and a bottom hem, and wherein the pouch is attached to a front interior surface of the pant leg between the knee and the bottom hem.

3. A pair of pants, comprising:

a pair of shorts;

first and second pant legs removably attached to the shorts to form a pair of long pants, wherein the first pant leg includes a side seam; and a pouch attached to an interior surface of the first pant leg, the pouch having a mouth that is accessible through an opening in the first pant leg, the pouch being dimensioned and positioned to receive the first and second pant lens after they have been removed from the shorts and folded up and wherein the opening in the first pant leg lies along a portion of the side seam.

4. The pants of claim 3, wherein the mouth of the pouch includes a zipper for closing the pouch, and wherein the zipper lies along a portion of the side seam.

5. The pants of claim 3, wherein the pouch includes a utility connector attached thereto, and wherein the shorts include a ring attached thereto for receiving the utility connector.

6. The pants of claim 5, wherein the utility connector is attached to an interior seam of the pouch.

7. The pants of claim 5, wherein the shorts include a waistband, and wherein the ring is attached to the shorts proximate to the waistband.

8. The pants of claim 7, wherein the shorts have left and right sides, and wherein the ring is attached to the right side of the shorts.

9. The pants of claim 1, wherein the first and second pant legs are attached to the shorts by first and second zippers.

10. The pants of claim 1, wherein the first and second pant legs are replaceable by different pants legs.

11. The pants of claim 1, wherein the first and second pant legs are reversible.

12. A method for making a pair of pants, comprising:

(a) removably attaching a pouch to an interior surface of a first pant leg, the pouch having a mouth that is accessible through an opening in the first pant leg, the pouch being dimensioned and positioned to receive the first pant leg and a second pant leg;

(b) removably attaching the first and second pant legs to a pair of shorts to form a pair of long pants.

13. The method of claim 12, wherein the first pant leg includes a knee region and a bottom hem, and wherein step (a) includes attaching the pouch to a front interior surface of the pant leg between the knee region and the bottom hem.

14. A method for making a pair of pants, comprising:

(a) removably attaching a pouch to an interior surface of a first pant leg, the pouch having a mouth that is accessible through an opening in the first pant leg, the pouch being dimensioned and positioned to receive the first pant leg and a second pant leg, wherein the first pant leg includes a side seam, and wherein step (a) further includes positioning the opening in the first pant leg along a portion of the side seam; and (b) removably attaching the first and second pant legs to a pair of shorts to form a pair of long pants.

15. The method of claim 14, wherein the mouth of the pouch includes a zipper for closing the pouch, and wherein step (a) includes positioning the zipper along a portion of the side seam.

16. The method of claim 14, further including:

attaching a utility connector to the pouch, and attaching a ring to the shorts for receiving the utility connector.

17. The method of claim 16, further includes attaching the utility connector to an interior seam of the pouch.

18. The method of claim 16, wherein the shorts include a waistband, and the step of attaching the ring to the shorts includes attaching the ring proximate to the waistband.

19. The method of claim 18, wherein the shorts have left and right sides, and wherein the step of attaching the ring to the shorts includes attaching the ring to the right side of the shorts.

20. The pants of claim 12, wherein step (b) includes using zippers to attach the first and second pant legs to the shorts.

* * * * *